US007765727B2

(12) United States Patent
Chen

(10) Patent No.: US 7,765,727 B2
(45) Date of Patent: Aug. 3, 2010

(54) THREE-DIMENSIONAL INFLATABLE CARD

(76) Inventor: Cheng-Wu Chen, 1F., No. 10, Lane 106, Wufu Rd., Lujhu Township, Taoyuan County (TW)

( * ) Notice: Subject to any disclaimer, the term of this patent is extended or adjusted under 35 U.S.C. 154(b) by 159 days.

(21) Appl. No.: 12/289,644

(22) Filed: Oct. 31, 2008

(65) Prior Publication Data

US 2010/0071236 A1 Mar. 25, 2010

(30) Foreign Application Priority Data

Sep. 23, 2008 (TW) ..... 97217148 U

(51) Int. Cl.
*G09F 1/00* (2006.01)

(52) U.S. Cl. ..... 40/124.08; 40/406; 446/220; 472/134

(58) Field of Classification Search ..... 40/124.08, 40/124.14, 427, 439, 406; 446/220, 147; 472/134

See application file for complete search history.

(56) References Cited

U.S. PATENT DOCUMENTS 4,857,029 A * 8/1989 Dierick et al. ..... 446/220
5,083,771 A * 1/1992 Tyner ..... 472/54
5,083,961 A * 1/1992 Ishiwa ..... 446/75
5,234,726 A * 8/1993 Dahan ..... 428/9
5,852,889 A * 12/1998 Rinaldi ..... 40/124.06
5,890,744 A * 4/1999 Chan ..... 283/117

* cited by examiner

*Primary Examiner*—Gary C Hoge
(74) *Attorney, Agent, or Firm*—Bacon & Thomas, PLLC

(57) ABSTRACT

This invention discloses a three-dimensional inflatable card including a card body having a containing space defined therein, an opening formed on each of two corresponding sides of the containing space, and a movable portion disposed on the card body at a position corresponding to a side of the containing space; an airbag adhered on the card body within the containing space, and containing a reacting powder and an acid solution pack; and a protective ring disposed around the periphery of the airbag, and having a thickness sufficient to contain the acid solution pack; wherein an acid solution in the acid solution pack is able to chemically react with the reacting powder to produce gas for enabling the airbag to expand to a predetermined volume, break the movable portion, and extend to the outside of the containing space, so as to form a three-dimensional inflatable object on the card body.

10 Claims, 8 Drawing Sheets

THREE-DIMENSIONAL INFLATABLE CARD

FIELD OF THE INVENTION

The present invention relates to a card, and more particularly to a three-dimensional inflatable card comprising an airbag fixed in a containing space of a card body, wherein the airbag is capable of expanding to a predetermined volume, breaking a movable portion of the card body, and then extending to the outside of the card body, so as to form a three-dimensional inflatable object on the card body.

BACKGROUND OF THE INVENTION

In general, a card such as a birthday card, a Christmas card, and a New Year greeting card is folded into two halves, and most card bodies are folded into two halves, and a text, a pattern or a figure is printed separately on external and internal sides of a first half, and an internal side of the second half is provided for writing a greeting message. When card manufacturers design and produce the aforementioned card, outstanding designs can be used to show special paper texture or pattern design, but the cards of this sort can show a monotonous flat visual effect only, and a three-dimensional visual effect cannot be achieved. Obviously, the traditional card not only has the drawback of a monotonous design, but also leaves no deep expression to the card receivers.

To overcome the shortcomings of the aforementioned cards, card manufacturers developed a three-dimensional card as shown in FIG. 1, and the three-dimensional card includes a card body 10 and an inner card 11, wherein the card body 10 is folded into two halves 101, 102, and a stylish pattern is printed onto the inner card 11, and an end of the inner card 11 is adhered onto an internal side of a half 101 of the card body 10, and another end of the inner card 11 is adhered onto an internal side of another half 102 of the card body 10. When the card body 10 is folded into two halves, the inner card 11 is accommodated into the two halves 101, 102. When the card body 10 is spread open, the inner card 11 is driven by the two halves 101, 102 of the card body 10 to erect at the internal side of the card body 10, such that the inner card 11 can show a three-dimensional visual effect. Such arrangement not only overcomes the shortcomings of a conventional card being too dull and monotonous, but also adds a memorial storage value to the card.

Although the three-dimensional card can overcome the shortcomings of the prior art and slightly show the three-dimensional visual effect, yet an inner card 11 of the three-dimensional card still comes with a planar style. Since the inner card 11 is driven by the two halves 101, 102 and erected on an internal side of the card body 10, the inner card 11 cannot show a dynamic effect for a surprise during the erecting process.

Therefore, it is an important subject of the invention to find a way of overcoming the shortcomings of a conventional three-dimensional card and providing a three-dimensional stylish design of the card to enhance the dynamic effect of the card.

SUMMARY OF THE INVENTION

In view of the foregoing shortcomings of the prior art, the inventor of the present invention based on years of experience in the related industry to conduct extensive researches and experiments, and finally designed a three-dimensional inflammable card in accordance with the present invention to overcome the shortcomings of the prior art.

Therefore, it is a primary objective of the present invention to provide a three-dimensional inflatable card comprising a card body, an airbag and a protective ring, wherein a portion of the card body is folded inward, and a side of the card body is adhered onto an internal side of the card body to define a containing space in the card body, and an opening is formed on both corresponding sides of the containing space separately, and a movable portion is disposed on the card body and corresponding to a side of the containing space. The airbag is adhered and fixed in the containing space and contains a reacting powder (such as a carbonate compound including sodium carbonate or sodium bicarbonate) and an acid solution pack, and the protective ring comprises two protecting elements capable of embedding with each other and is disposed around the periphery of the airbag, wherein the protective ring has a thickness sufficient to contain the acid solution pack and prevent the acid solution pack from being pressed or cracked during the transportation process of the three-dimensional inflatable card, and each of the protecting elements is coupled to an end of a pull string, and another end of each pull string is coupled to the card body and at a position proximate to each opening. The card body includes a tear line disposed at a position proximate to another end of each pull string, such that after a user tears the edge of the card body along each tear line by holding and pulling each pull string, the protecting elements can be separated from each other, and each of the protecting elements can be pulled out from each opening to the outside of the containing space. The user presses the card body at a position corresponding to the airbag to break the acid solution pack and allow an acid solution (such as citric acid, acetic acid, and dilute hydrochloric acid) to flow out. After the acid solution is chemically reacted with the reacting powder to produce carbon dioxide, the carbon dioxide gas expands the airbag to a predetermined volume and drives the airbag to prop open the movable portion and extend the movable portion to the outside of the containing space, so as to form a three-dimensional inflatable stylish card.

Another objective of the present invention is to design an embedding portion at both ends of each protecting element separately, such that the embedding portions at both ends of one of the protecting elements are embedded into the embedding portions on both ends of another protecting element as a whole to constitute the protective ring.

A further objective of the present invention is to design the cross-section of the containing space in a rectangular shape to facilitate the airbag and the protective ring to be contained in the containing space, and make it easier for card manufacturers to transport the three-dimensional inflatable card.

Another objective of the present invention is to design a blowing nozzle of the airbag, such that users can open the blowing nozzle to release the carbon dioxide gas in the airbag in order to reduce the volume of the three-dimensional inflatable card for an easy storage of the three-dimensional inflatable card. Further, users can blow air into the airbag through the blowing nozzle.

The objects, technical characteristics and effects of the present invention will become apparent from the following detailed description taken with the accompanying drawings.

DETAILED DESCRIPTION OF THE PREFERRED EMBODIMENTS

Figure 1:
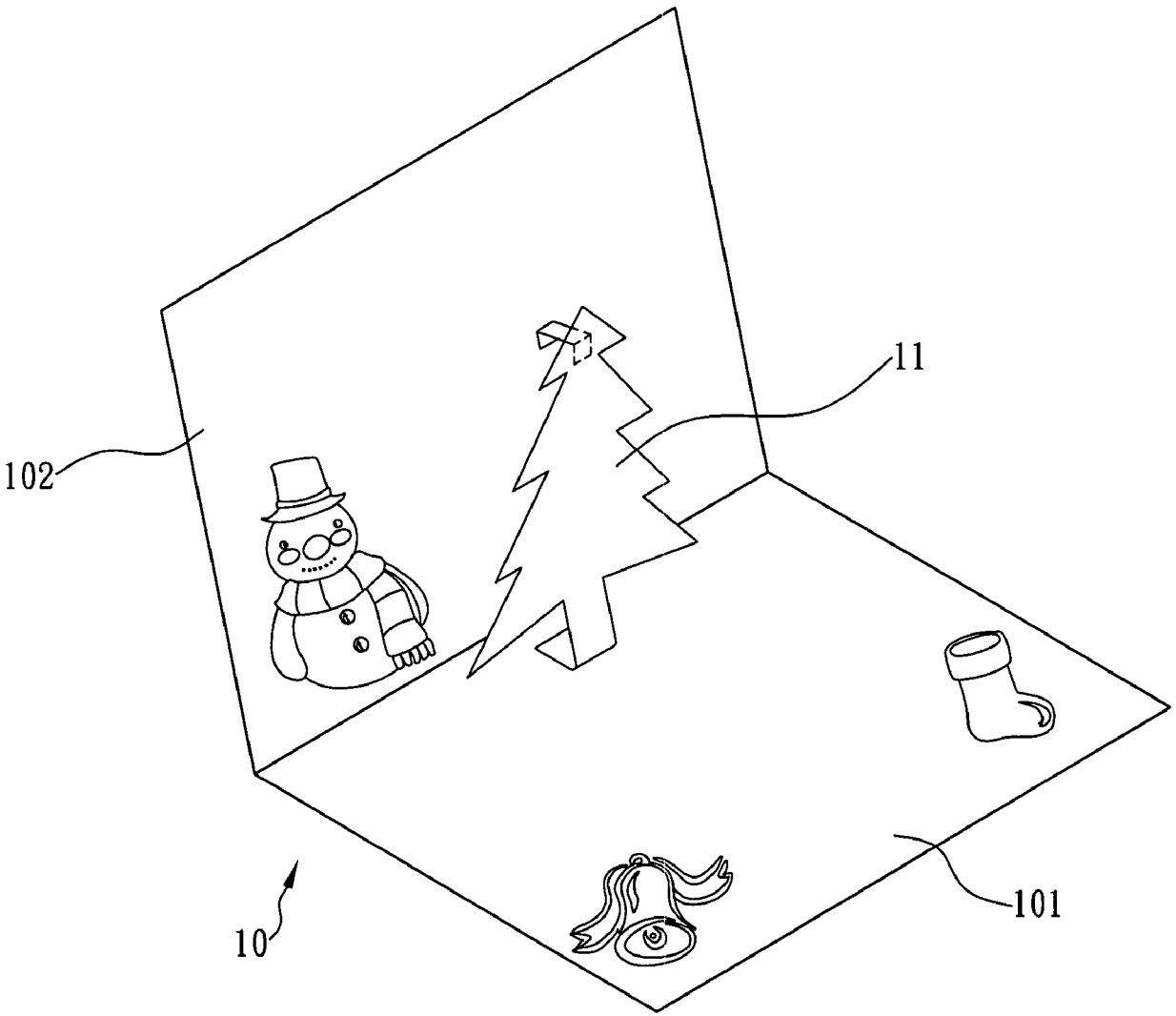
FIG. 1 (Prior Art)
FIG. 1 is a perspective view of a three-dimensional card in accordance with a prior art.
Figure 2:
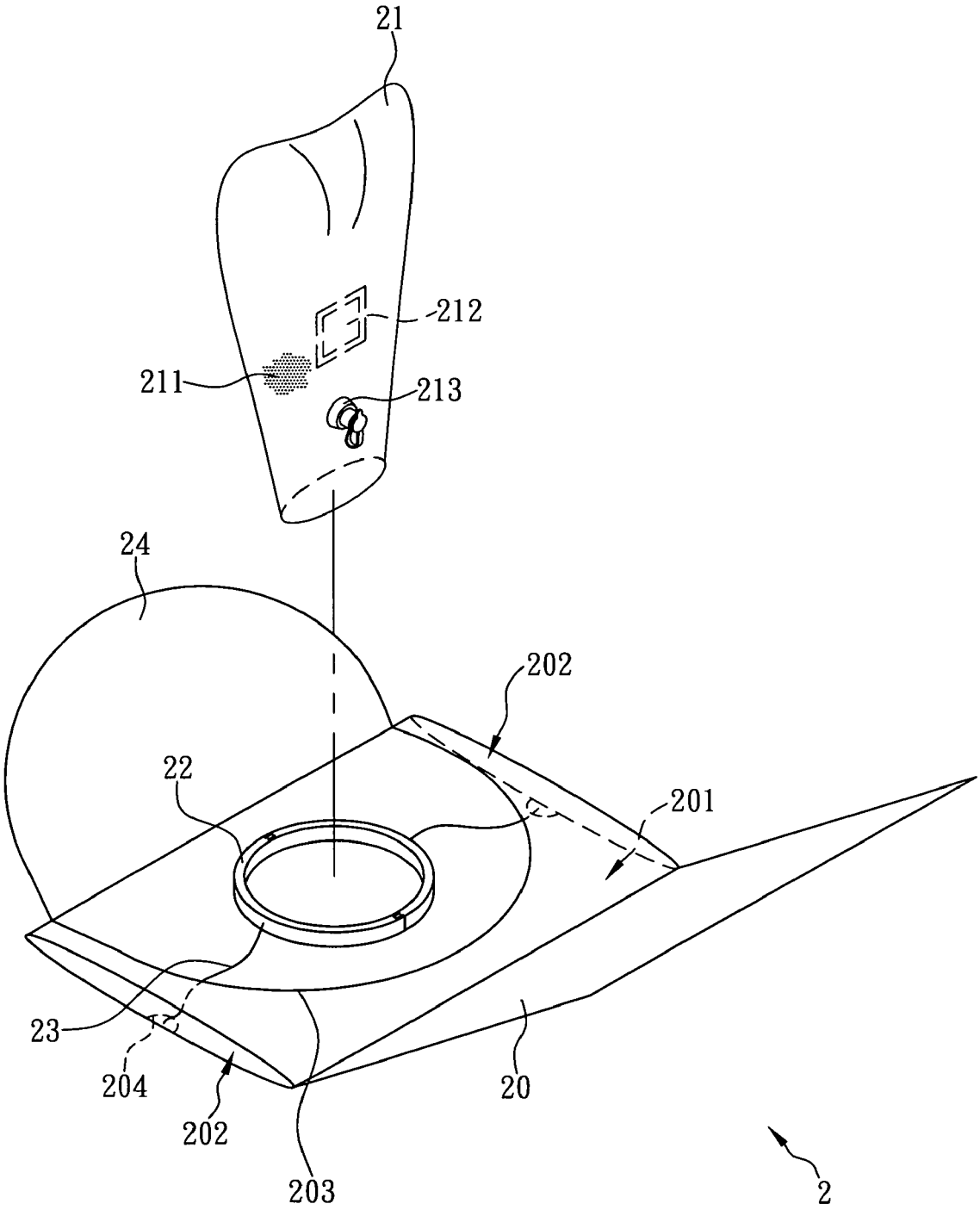
FIG. 2 is a perspective view of a first preferred embodiment of the present invention.
Figure 3:
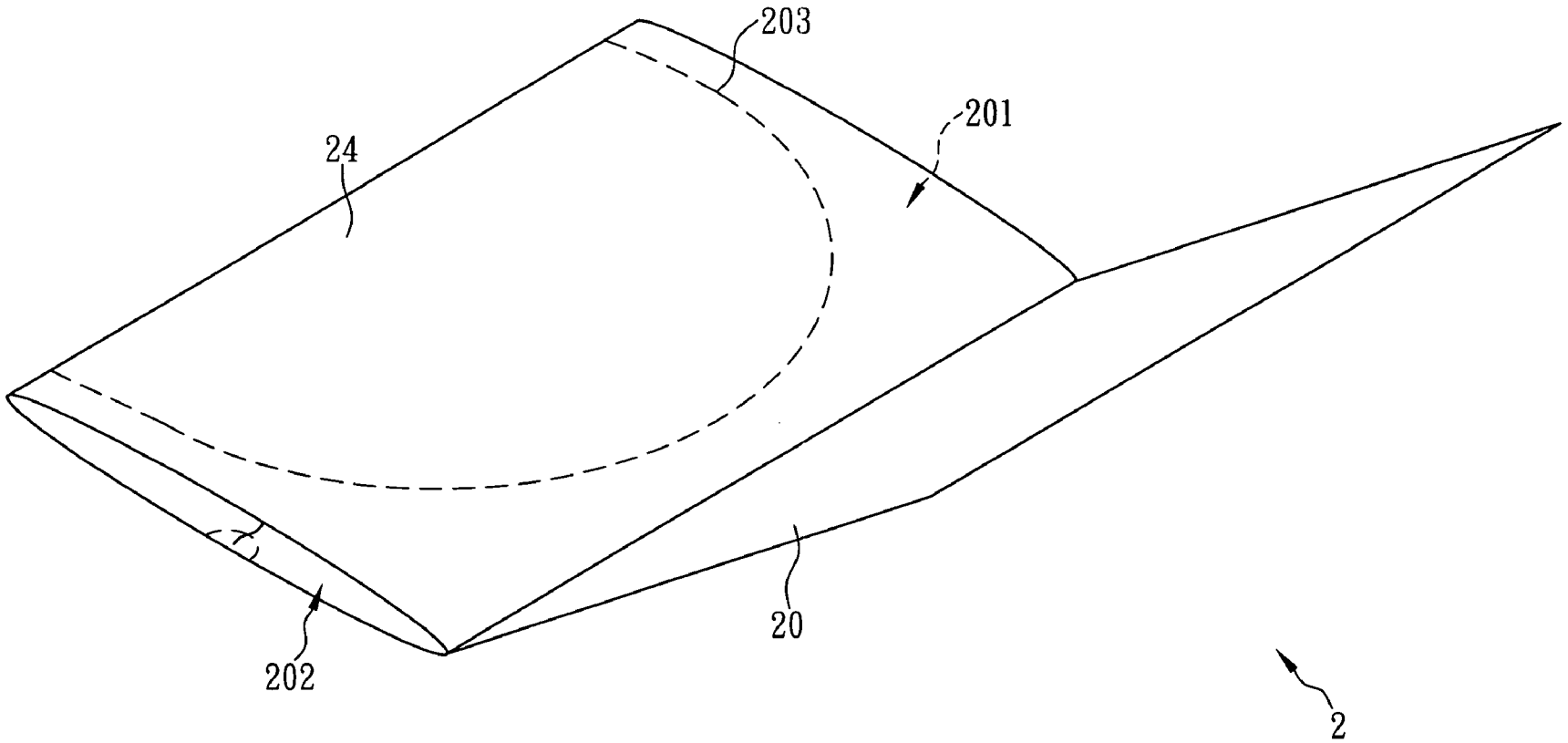
FIG. 3 is another perspective view of a first preferred embodiment of the present invention.
Figure 4:
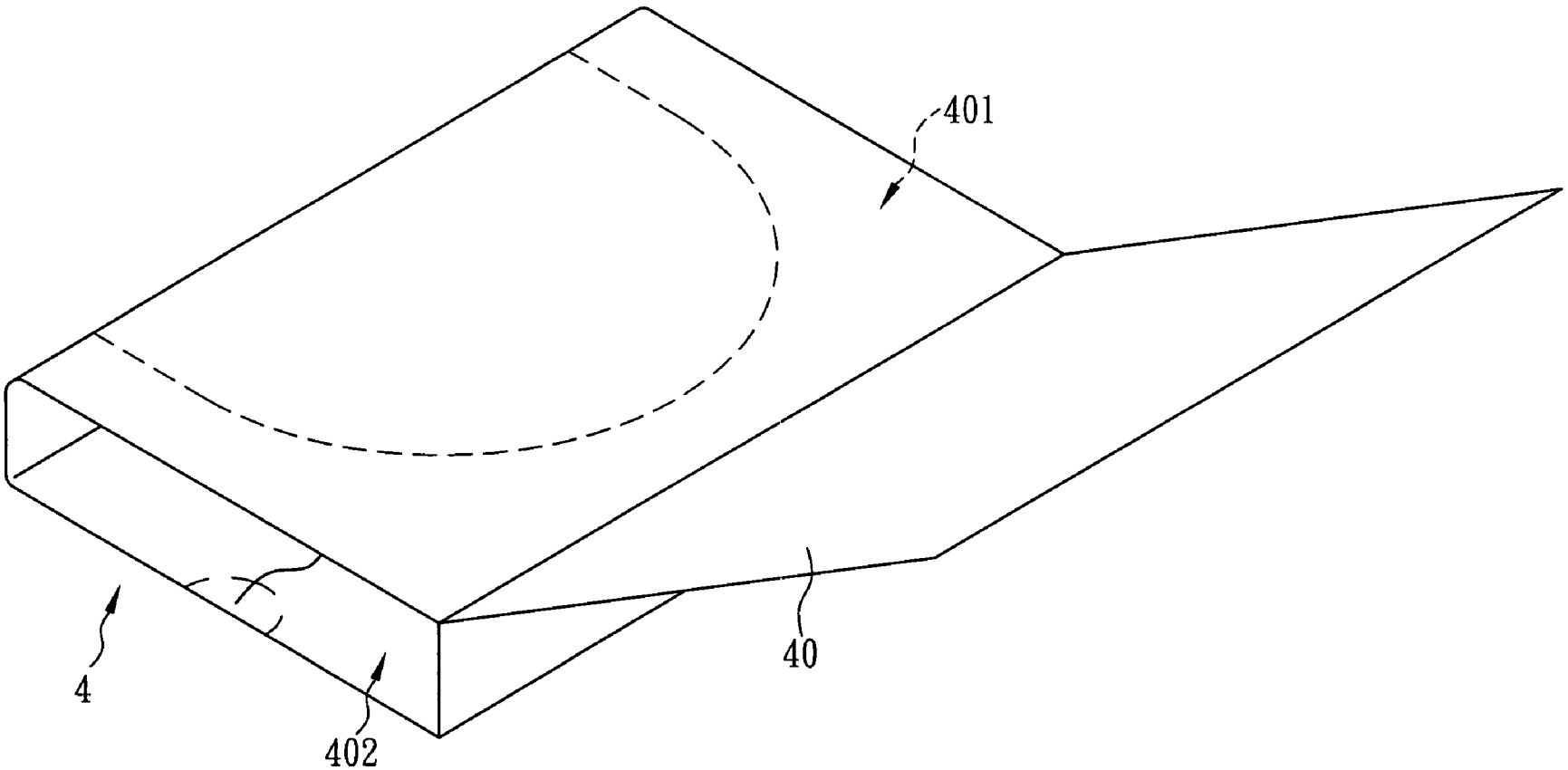
FIG. 4 is a further perspective view of a first preferred embodiment of the present invention.

To make it easier for our examiner to understand the technical characteristics of the present invention, we use preferred embodiments together with the accompanying drawings for the detailed description of the invention as follows:

With reference to FIGS. 2 and 3 for a three-dimensional inflatable card in accordance with a first preferred embodiment of the present invention, the three-dimensional inflatable card 2 comprises a card body 20, an airbag 21 and a protective ring 22, wherein a portion of the card body 20 is folded inward, and a side of the card body 20 is adhered onto an internal side of the card body 20 to define a containing space 201 in the card body, and an opening 202 is formed on both corresponding sides of the containing space 201 separately. In FIG. 2, an opening 202 disposed separately on both corresponding sides of the containing space 201 is substantially in an oval shape, but not limited to such arrangement only. With reference to FIG. 4, the shape of each opening 402 can be changed according to the design requirements when card manufacturers fold the card body 40, so that the cross-section of the containing space 401 can be in a rectangular shape. In other words, the opening 402 is in a rectangular shape, not only facilitating the airbag and the protective ring to be contained in the containing space 401, but also allowing card manufacturers to transport the three-dimensional inflatable card 4 more easily.

In FIGS. 2 and 3, the card body 20 includes a break line 203 disposed at a position corresponding to a side of the containing space 201. In this preferred embodiment, the break line 203 is in a curved shape, and both ends of the break line 203 are extended to a folding position of the card body 20 to form a movable portion 24, but not limited to such arrangement only. The break line 203 is in a U-shape or any other shape, such that even if both ends of the break line 203 are not extended to the folding position of the card body 20, the following procedure (such as inflating the airbag 21) can still be carried out.

In addition, the airbag 21 is made of polyvinyl chloride (PVC) or polyethylene (PE), and an end of the airbag 21 is adhered and fixed in the containing space 201, and a reacting powder 211 (such as a carbonate compound including sodium carbonate or sodium bicarbonate) and an acid solution pack 212 are contained in the airbag 21, and the acid solution pack 212 is filled with an acid solution such as citric acid, acetic acid and dilute hydrochloric acid, etc.

Figure 5:
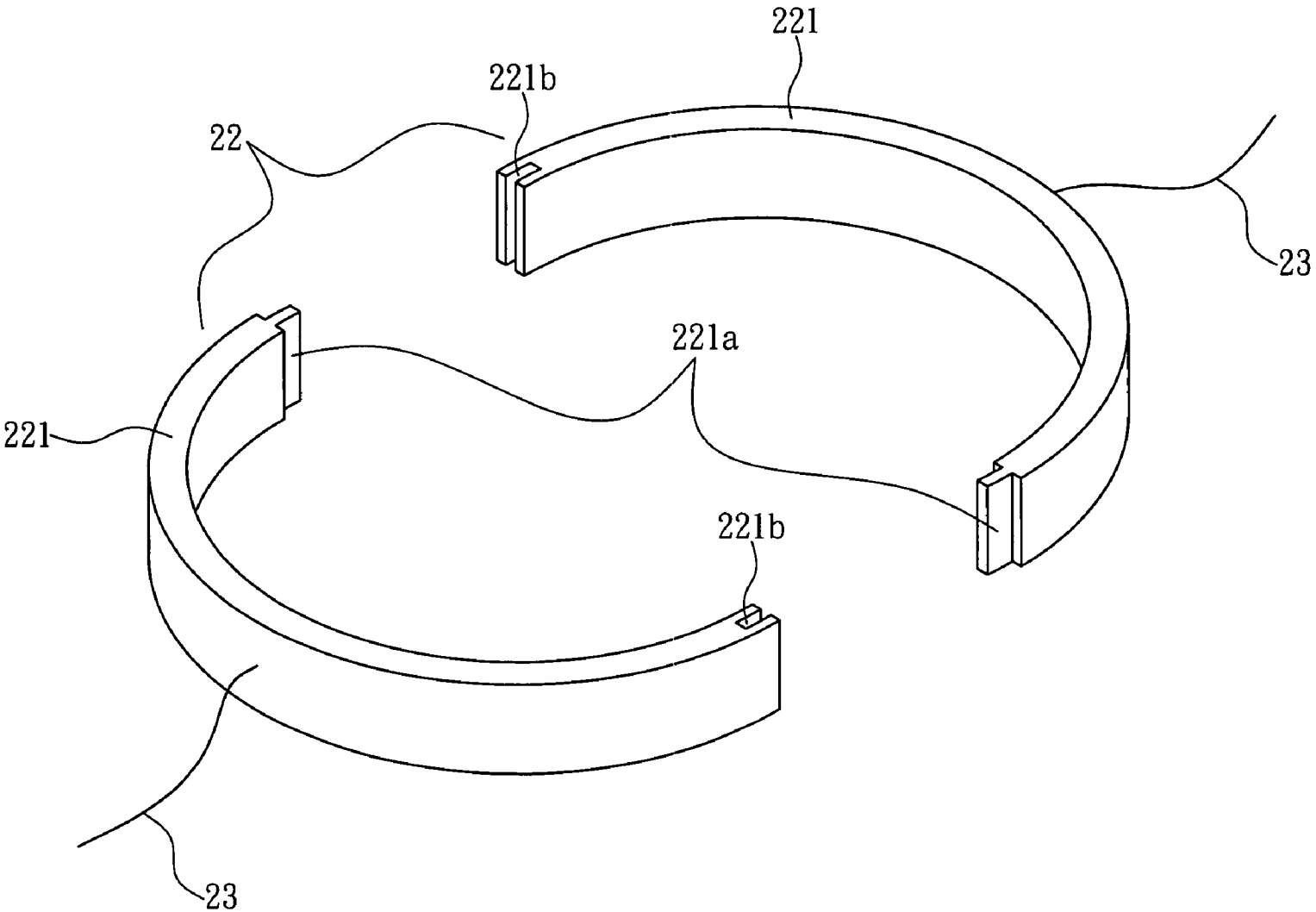
FIG. 5 is a perspective view of a protective ring in accordance with a first preferred embodiment of the present invention.

With reference to FIG. 5, the protective ring 22 comprises two protecting elements 221 capable of embedding with each other, and each of the protecting elements 221 is coupled to an end of a pull string 23, and an end of each protecting element 221 has a convex embedding portion 221*a*, and another end of each protecting element 221 includes a concave embedding portion 221*b*, and each convex embedding portion 221*a* can be embedded into each concave embedding portion 221*b*, such that the protecting elements 221 can be engaged and integrated with each other to constitute the protective ring 22. With reference to FIG. 2, the protective ring 22 is disposed around the periphery of the airbag 21, such that when the airbag 21 is not inflated, the airbag 21 is pressed and contained in the protective ring 22, and the protective ring 22 has a thickness sufficient to prevent the acid solution pack 212 from being pressed or cracked during the process of transporting the three-dimensional inflatable card 2. Another end of each pull string 23 is coupled to the card body 20 and disposed at a position proximate to each opening 202, and the card body 20 has a tear line 204 disposed on the card body 20 and proximate to another end of each pull string 23.

Figure 6:
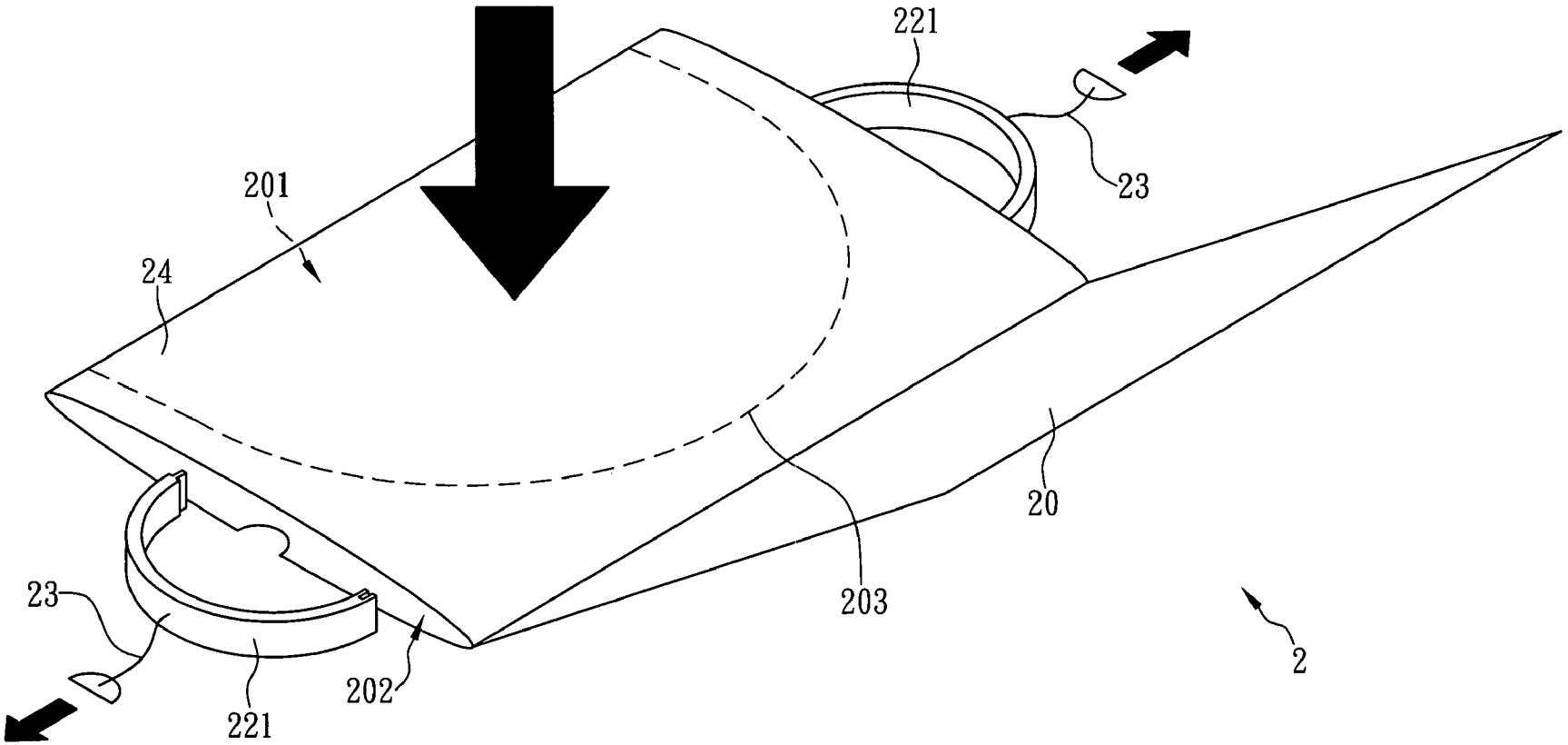
FIG. 6 is a schematic view of an operation in accordance with a first preferred embodiment of the present invention.
Figure 7:
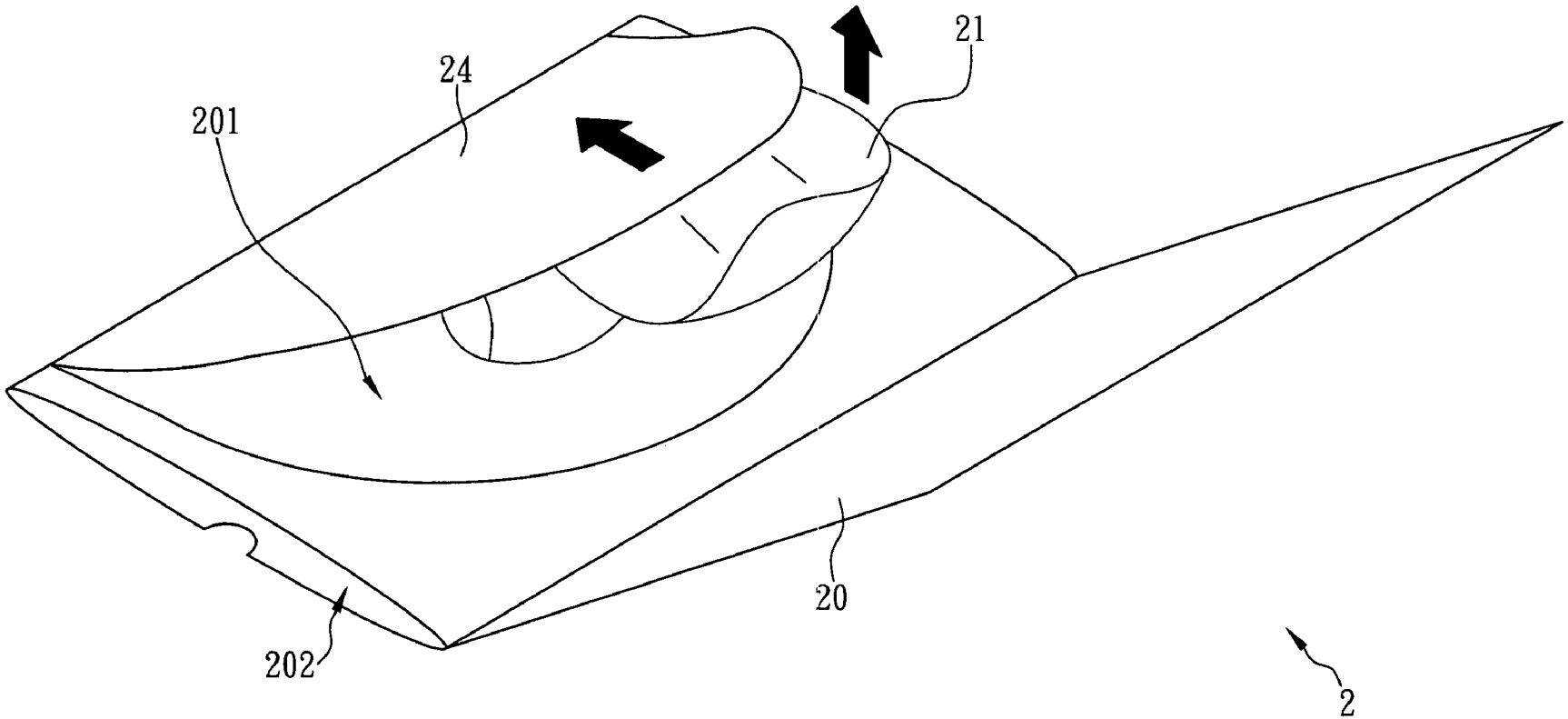
FIG. 7 is another schematic view of an operation in accordance with a first preferred embodiment of the present invention.

In the first preferred embodiment, if a user tears an edge of the card body 20 along each tear line 204, the user holds and pulls each pull string 23 to separate the protecting elements 221 as shown in FIG. 6. The user can pull each protecting element 221 from each opening 202 to the outside of the containing space 201. When the user presses the card body 20 at a position corresponding to the airbag 21, the user can break the acid solution pack 212 and allow the acid solution to flow out. After the acid solution is chemically reacted with the reacting powder 211 to produce carbon dioxide, the carbon dioxide gas expands the airbag 21 to a predetermined volume as shown in FIG. 7, and the airbag 21 will break through the break line 203 of the card body 20 to prop open the movable portion 24, and protrude the movable portion 24 to the outside of the containing space 201, so as to form a three-dimensional inflatable object on the card body.

With reference to FIG. 2 for the first preferred embodiment again, the airbag 21 further comprises a blowing nozzle 213. After the carbon dioxide gas in the airbag 21 is discharged, users can blow air into the airbag 21 through the blowing nozzle 213 to maintain the three-dimensional shape of the airbag 21. Further, users can open the blowing nozzle 213 to release air in the airbag 21 and reduce the volume of the three-dimensional inflatable card 2 for an easy storage of the three-dimensional inflatable card 2.

Figure 8:
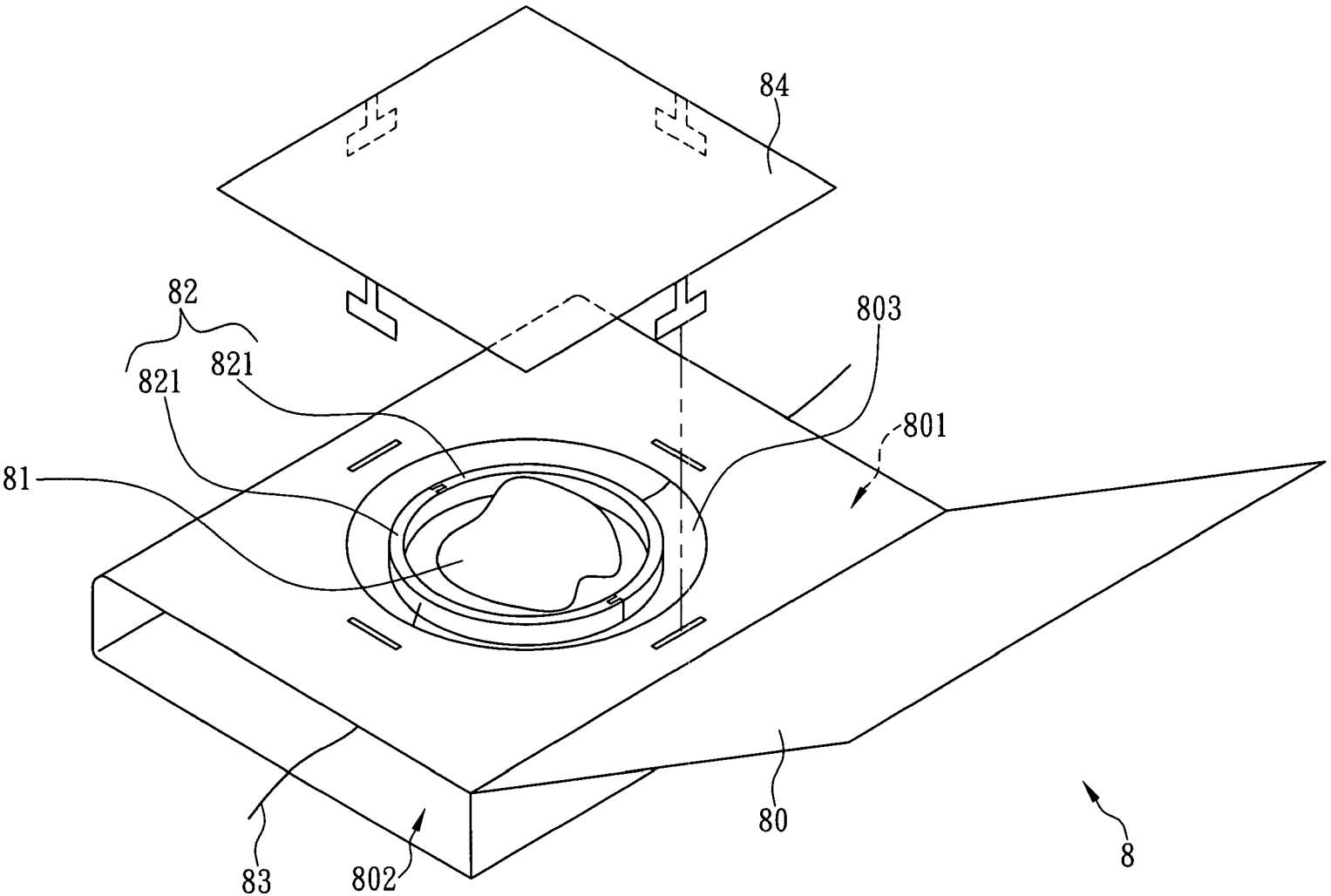
FIG. 8 is a perspective view of a second preferred embodiment of the present invention.

With reference to FIG. 8 for a second preferred embodiment of the present invention, the three-dimensional inflatable card 8 comprises a card body 80, an airbag 81 and a protective ring 82, wherein a portion of the card body 80 is folded inward, and a side is adhered onto an internal side of the card body 80 to define a containing space 801 in the card body 80, and an opening 802 is formed on both corresponding sides of the containing space 801 separately, and a movable opening 803 is disposed on the card body 80 and at a side of the containing space 801, and the card body 80 is covered by a movable portion, and the movable portion is a movable card 84 embedded onto the card body 80 to seal the movable opening 803. However, card manufacturers may change the way of fixing the movable card 84 onto the card body 80 as needed. For instance, the movable card 84 is adhered to the movable opening 803 by a tape or a glue to seal the movable opening 803.

The airbag 81 is accommodated in the containing space 801, and the airbag 81 contains a reacting powder and an acid solution pack, and the protective ring 82 is comprised of two protecting elements 821 engaged with each other and disposed around the periphery of the airbag 81, and the protective ring 82 has a thickness sufficient to prevent the acid solution pack in the airbag 81 from being cracked during the process of transporting the three-dimensional inflatable card 8, and each of the protecting elements 821 is coupled to an end of a pull string 83.

In the second preferred embodiment, after a user pulls each pull string 83, each protecting element 821 is pulled out of the containing space 801, and the user can compress the card body 80 at a position corresponding to the airbag 81 to crack the acid solution pack and allow the acid solution to flow out and chemically react with the reacting powder to produce carbon dioxide, so that the airbag 81 can be expanded to a predetermined volume to prop the movable card 84 out from the containing space 801 to form a three-dimensional inflatable object on the card body.

While the invention has been described by means of specific embodiments, numerous modifications and variations could be made thereto by those skilled in the art without departing from the scope and spirit of the invention set forth in the claims. For instance, the protective ring is not limited to a circular shape, but it can be in the shape of a square, a rhombus, a pentagon, a hexagon or any other geometric shape to match the stylish design of the three-dimensional inflatable card.

What is claimed is:

1. A three-dimensional inflatable card, comprising:

a card body having a portion folded inward and a side attached onto an internal side of the card body for defining a containing space in the card body, wherein an opening is formed on each of two corresponding sides of the containing space, and a movable portion is disposed on the card body at a position corresponding to a side of the containing space;

an airbag adhered and fixed on the card body within the containing space, and containing a reacting powder and an acid solution pack therein, wherein the acid solution pack is filled with an acid solution capable of chemically reacting with the reacting powder to produce gas; and a protective ring disposed around the periphery of the airbag, and having a thickness sufficient to contain the acid solution pack, wherein the protective ring comprises two protecting elements capable of embedding with each other, and each of the protecting elements is coupled to an end of a pull string.

2. The three-dimensional inflatable card of claim 1, wherein each of the protecting elements includes an embedding portion disposed at both ends of the protecting element separately, such that the embedding portions on both ends of the protecting element are embedded into the embedding portions on both ends of the other protecting element as a whole to form the protective ring.

3. The three-dimensional inflatable card of claim 2, wherein the card body has a break line disposed at a position corresponding to a side of the containing space for forming the movable portion.

4. The three-dimensional inflatable card of claim 2, wherein the card body has a movable opening disposed on a side of the containing space, and the movable opening is sealed and covered by the movable portion.

5. The three-dimensional inflatable card of claim 3, wherein another end of the pull string is coupled to the card body at a position proximate to the opening, and the card body includes a tear line disposed at a position proximate to the another end of the pull string.

6. The three-dimensional inflatable card of claim 4, wherein another end of the pull string is coupled to the card body at a position proximate to the opening, and the card body includes a tear line disposed at a position proximate to the another end of the pull string.

7. The three-dimensional inflatable card of claim 5, wherein the airbag includes a blowing nozzle.

8. The three-dimensional inflatable card of claim 6, wherein the airbag includes a blowing nozzle.

9. The three-dimensional inflatable card of claim 7, wherein the containing space has a rectangular cross-section.

10. The three-dimensional inflatable card of claim 8, wherein the containing space has a rectangular cross-section.

* * * * *